United States Patent [19]

Gustafsson et al.

[11] Patent Number: 4,534,144

[45] Date of Patent: Aug. 13, 1985

[54] UNDERGROUND BOMB SHELTER/STORAGE CELLER UNIT

[76] Inventors: Bert Gustafsson, Rönnvägen 8, S-370 34 Holmsjö; Hans-Erik Sträng, Lövängsvägen 9, S-370 20 Lyckeby, both of Sweden

[21] Appl. No.: 441,076

[22] Filed: Nov. 12, 1982

[51] Int. Cl.[3] ..... E02D 27/00

[52] U.S. Cl. ..... 52/169.6; 52/86; 52/167; 52/309.1

[58] Field of Search ..... 52/86, 169.6, 167, 309

[56] References Cited

U.S. PATENT DOCUMENTS

| | | | |
|---|---|---|---|
| 2,816,329 | 12/1957 | Sogaro | 52/86 |
| 2,968,130 | 1/1961 | Bascom | 52/169.6 |
| 3,996,630 | 12/1976 | Maderna | 52/169.6 |
| 4,222,206 | 9/1980 | Kitamura | 52/167 |

FOREIGN PATENT DOCUMENTS

| | | | |
|---|---|---|---|
| 3024437 | 1/1982 | Fed. Rep. of Germany | 52/169.6 |
| 1314461 | 12/1962 | France | 52/169.6 |
| 2503777 | 10/1982 | France | 52/169.6 |
| 526019 | 3/1984 | United Kingdom | 52/169.6 |

*Primary Examiner*—Henry E. Raduazo

*Attorney, Agent, or Firm*—Harness, Dickey & Pierce

[57] ABSTRACT

A bomb shelter which is intended to be used as an underground storage celler in peacetime. The bomb shelter consists of a cylindrical body of fiberglass-reinforced plastics, on which body are provided peripheral and lengthwise stiffening members. The body is made up of two sections which are interconnected by a sealed joint. The bomb shelter has one forwards end wall and an inner end wall, each one with its separate door. The bomb shelter is partly buried in the ground and covered by insulating material, which in addition to having a protective effect also provides insulation for the underground storage celler.

4 Claims, 6 Drawing Figures

II
II
1
2
3
4
5
6
7
8
10
11
11
25
26
27
28
29
30

UNDERGROUND BOMB SHELTER/STORAGE CELLER UNIT

BACKGROUND OF THE INVENTION

The invention relates to a combined underground bomb shelter and storage celler unit. In peacetime, the unit in accordance with the invention serves as an underground storage celler but when the need arises, the unit may serve as a bomb shelter.

The military budget generally covers weapons and military installations and equipment. In most countries, there is a serious shortage of bomb shelters. In the majority of these countries, in West Germany and Great Britain to mention a few, the shortage is so serious that only a few percent of the population would have access to bomb shelters in case of a crisis situation. Also in other countries, such as in Sweden, where building and installation of bomb shelters progress according to a plan adopted by the authorities, the actual need for bomb shelters exceeds that of the official plan. Modern wars take their toll of civilians (between 80 and 90 percent of the war casualties).

Weapons used in modern wars for bombing and shelling are constructed to cause maximum bodily injuries. It is therefore absolutely vital that bomb shelters in sufficient numbers are available in wartime. In addition, the increase in efficiency and speed of the modern war machine makes it possible to attack at very short notice. It may therefore be assumed that there will be no time to build and install bomb shelters once a war has started.

The efficiency of a weapon decreases in proportion to the square of the distance from the point of detonation or impact of the weapon. Consequently, the chances of survival increase markedly in areas outside the direct point of impact and the immediate vicinity thereof.

In conclusion, to build and install a large number of small, well scattered bomb shelters would be desirable, as this would diminish the risk of direct hits and thus save lives. It is likewise important that the bomb shelters are located to allow the civilians to reach them quickly when the alert is sounded. Thus, there is an immediate need for small, simple and inexpensive bomb shelters.

Conventional air-raid shelters providing satisfactory protection usually are large-size units intended to accommodate a comparatively large number of persons. The building and installation costs of such large units are considerable, and it would not be a realistic goal to build shelters of this type in a sufficient number to offer adequate protection to all civilians.

SUMMARY OF THE INVENTION

The purpose of the subject invention is to provide a bomb shelter affording satisfactory shelter to several small groups of people while at the same time being capable of serving as an underground storage celler in times of peace. The bomb shelter is inexpensive and easy to manufacture and mount at the desired location.

These purposes are achieved in a shelter in accordance with the invention, which shelter is characterised in that it consists of an essentially cylindrical body of fiberglass-reinforced plastics, that the shelter body is provided along its wall with peripherally extending reinforcing stiffening members, that the bomb shelter is produced in a number of separate sections which are interconnected by sealed joints, that the bomb shelter is provided with a forwards external end wall and with an inner end wall spaced a predetermined distance from the external end wall, and that both the external end wall and the internal end wall are provided with its respective door arranged to be opened outwards.

Further characteristics and advantages of the bomb shelter in accordance with the invention will become apparent from the following detailed description and the appended claims.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 1:
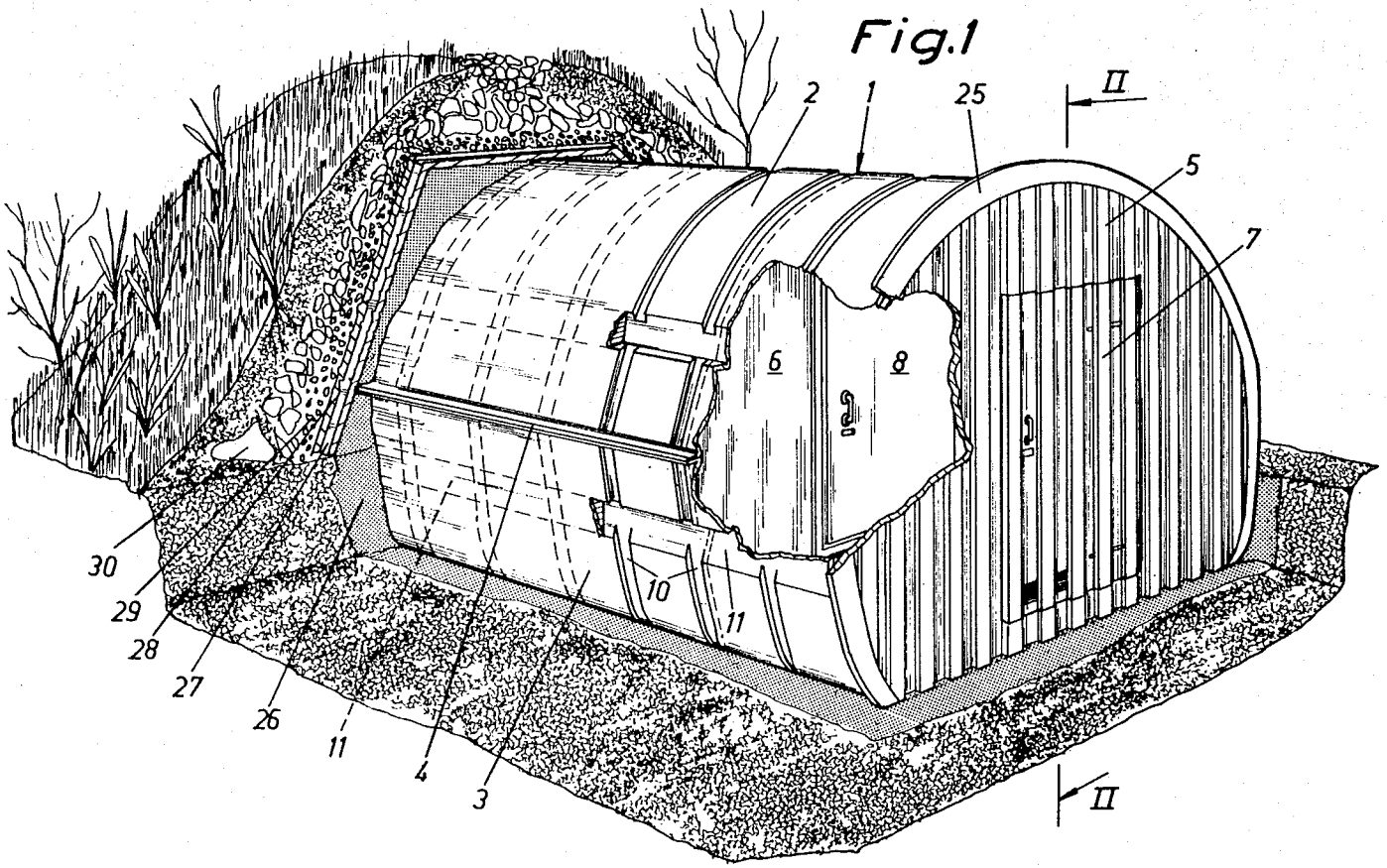
FIG. 1 is a perspective view of a combination underground bomb shelter and storage celler in accordance with the invention.

The bomb shelter unit, generally indicated by numeral 1, consists in accordance with the teachings of the subject invention of two sections, one upper section 2 and a bottom section 3. The sections are bonded together along a joint 4. The bomb shelter 1 further comprises a front end wall 5 and an interior end wall 6. Each end wall 5 and 6 is provided with a door 7 and 8, respectively. These doors 7, 8 open outwards and in their closed position they abut against sealing strips mounted on the door frames, providing an air-tight closure. Preferably, means are also provided to allow the doors to be bolted from the inside at all four corners. The bomb shelter unit 1 is likewise provided with a rear end wall 9, the latter preferably provided with an emergency exit (not shown) to allow the shelter to be evacuated in case the front doors are blocked.

The bomb shelter unit 1 is provided with reinforcing stiffening members 10 extending round the circumference of the peripheral walls of the cylindrical shelter body. These reinforcing stiffening members are comparable to the stringers of boat hulls. The shelter unit is likewise equipped with lengthwise extending reinforcing stringer members 11, providing additional strength. Also the rear end wall 9 may be equipped with stringer members 10.

Figure 6:
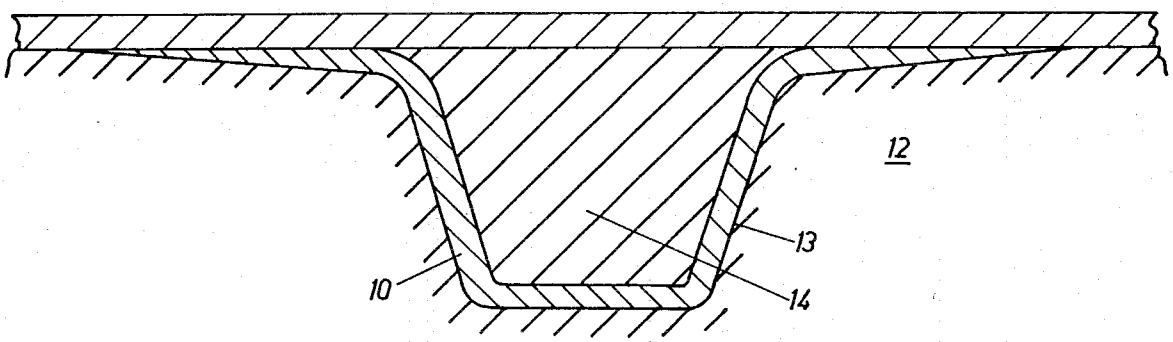

The bomb shelter is made from fiberglass-reinforced plastics. In the manufacture thereof, laminates are built up from plastics and reinforcing materials on a mould 12 (FIG. 6) which serves as a core. The mould is formed with indentations 13 serving to shape the reinforcing stiffening members 10 and 11. FIG. 6 shows a groove or indentation 13 by means of which are formed the peripheral stiffening members 10. The latter are produced by covering, in a first phase of the manufacture, the walls of the indentation 13 with fiberglass-reinforced plastics, followed by filling the indentation completely with a filler 14 of a plastics material. Alternatively, the indentation may be only partly filled or even left completely unfilled, in which case the stiffening member will have the shape of a hollow channel. The stiffening member 10 is thereafter closed at its base and the entire bomb shelter section is subsequently produced in the conventional manner from plastics laminates. The lengthwise stiffening members 11 are made before the peripheral ones. At the cross-over points between the crosswise (peripheral) stiffening members 10 and the lengthwise stiffening members 11 indentations have previously been made in the lengthwise stiffening members 11 corresponding to those indentations 13 in which the peripheral stiffening members 10 are produced. Owing to this arrangement, the stiffening members 10 will extend ununterrupted through the lengthwise stiffening members 11.

FIG. 1 illustrates the principle of the build-up of the stiffening members 10, 11 and for this purpose shows the stiffening members in unfilled and unclosed condition at the front part of the bomb shelter and in closed condition at the rear part thereof. Obviously, the stiffening members 10, 11 will be closed in the finished bomb shelter 1 for maximum strength and durability.

Figure 4:
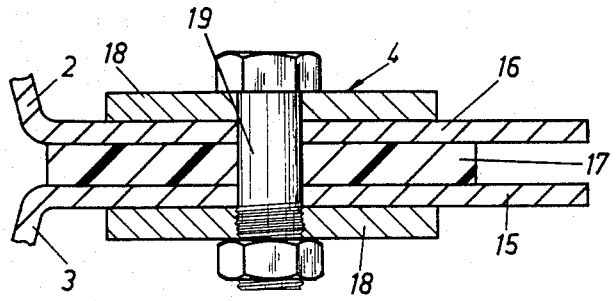
FIGS. 4, 5 and 6 are partial cross-sectional views of details incorporated in the bomb shelter unit.

The two sections 2 and 3 of the bomb shelter are manufactured in the manner described above and are thereafter interconnected along the joint 4 (see FIG. 4). Along the joint 4 the marginal portions of the lower section 2 and of the upper section 3 of the shelter project outwards in the form of parallel flanges 15 and 16 sandwiching between them a seal 17 in the form of an acidproof rubber cloth. On both sides of the flanges 15, 16 are provided washers 18 and bolts 19 spaced equidistantly along the joint at comparatively short intervals.

Figure 5:
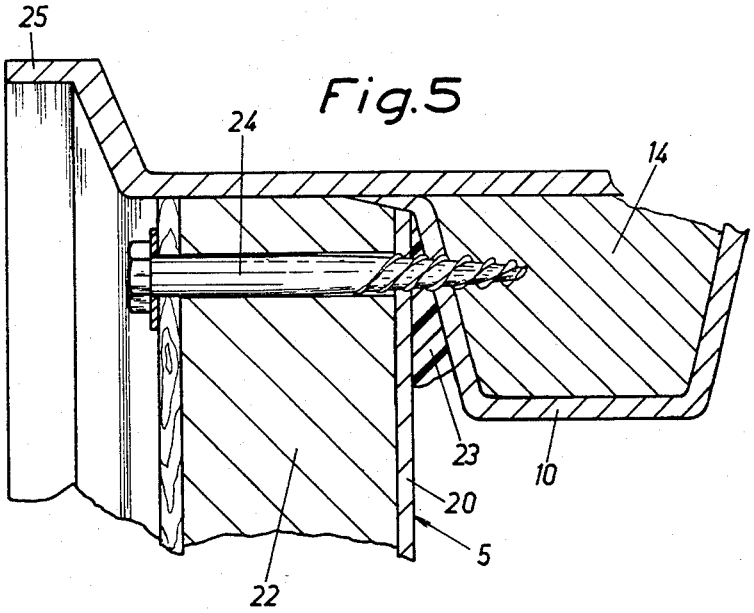

The front end walls 5, 6 of the bomb shelter are positioned a predetermined distance apart, whereby an antechamber is formed between them (see FIG. 1). In the antechamber it is possible to install a toilet (not shown). The two end walls 5, 6 are mounted in a manner ensuring that their outer radial edges will be positioned adjoining and externally of one of the peripheral stiffening members 10, see FIG. 5, which drawing figure illustrates the attachment of the front end wall 5 to one of the stiffening members 10. In accordance with the embodiment shown in FIG. 5 the front end wall is a sandwich structure comprising a rear laminate layer 20 of fiberglass-reinforced plastics and a front layer 21 which may be made of a laminate material, of wood or of other suitable materials. Intermediate the two layers 20 and 21 is arranged a core 22, preferably consisting of foamed polyvinyl chloride. A sealing compound 23 is applied between the front end wall 5 and the stiffening member 10. The front end wall 5 is secured to the stiffening member 10 with the aid of a screw 24 extending through the end wall 5 and the sealing compound 23 and into the stiffening member 10. Similarly, the inner end wall 6 is secured to another one of the stiffening members 10. This manner of securing the stiffening members (to the end walls) ensures that the end walls are capable of withstanding pressure waves. FIG. 5 also shows a collar flange 25 extending around and externally of the front end wall 5.

FIG. 1 shows the bomb shelter 1 as buried in the ground and covered by soil. If possible, the lower part of the bomb shelter should extend at least 50 cm down into the ground. The farther down the bomb shelter is buried into the ground the better the protection offered by the shelter. Also the insulating properties are improved, which is advantageous when the shelter is used as a storage celler. Preferably a shock-absorbing blanket or other equivalent material is positioned underneath the bomb shelter. Alternatively, an internal floor is provided in the shelter, resiliently mounted on the lower floor in order to give protection against shocks. The lower floor consists of a continuous laminate structure. The bomb shelter is covered as follows, starting with the layer closest to the shelter: one layer of sand 26, insulating slabs 27 of a material, marketed under the denomination of styrolite, a layer 28 of plywood, planks or the like, excavated material 29 containing no stones, one layer 30 of comparatively large stones positioned in interfitted relationship and finally a surface layer 31 of top soil. Grass and bushes are planted in the top soil to prevent erosion.

The design of the shelter together with the fact that it is buried in the ground make it suitable for use not only as a bomb shelter but also as an underground storage celler because of the satisfactory insulation properties and because the temperature levels will remain constant at all times. These properties make the underground celler very suitable for storage of food-stuffs of various kinds.

Figure 2:
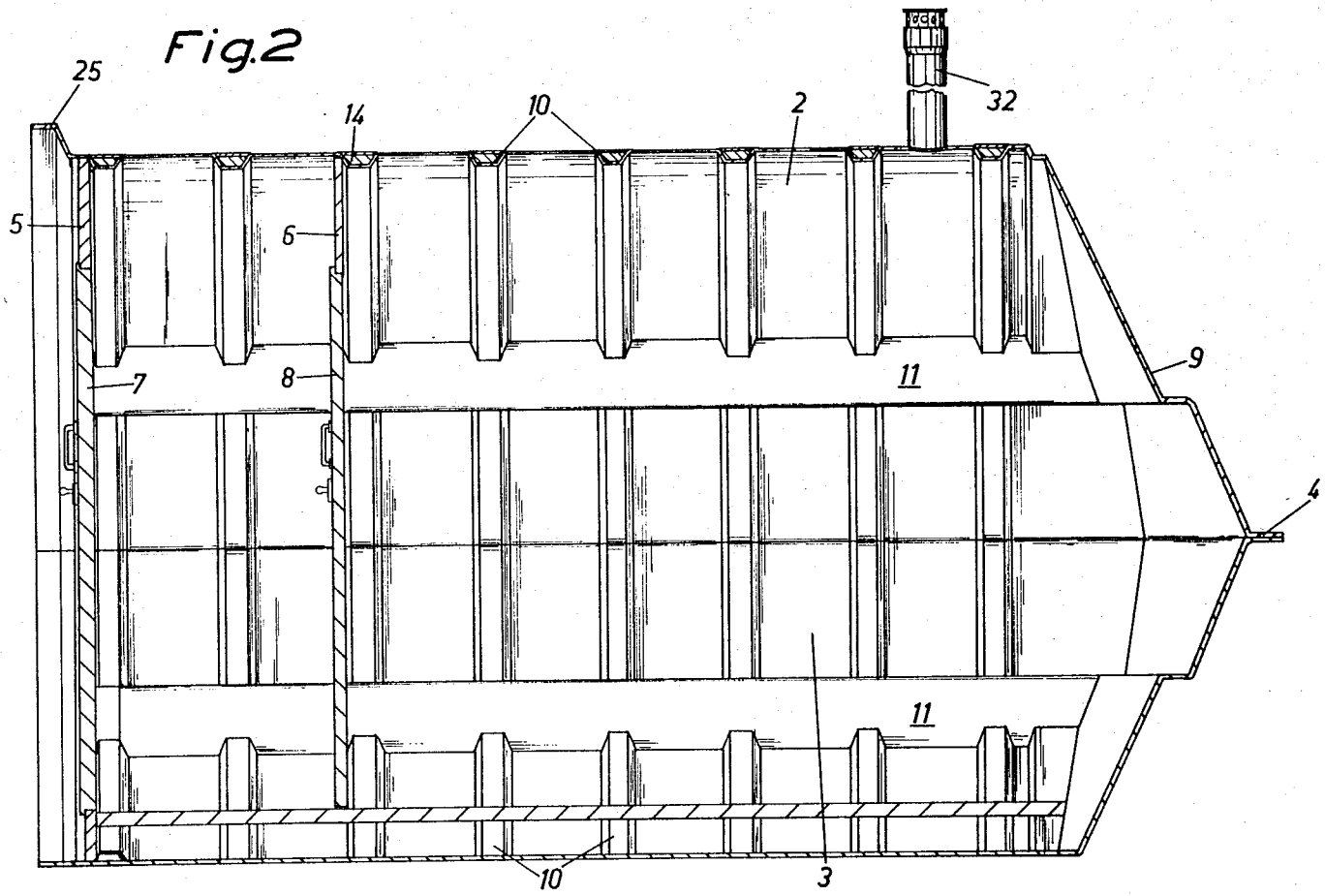
FIG. 2 is a longitudinal sectional view along line II—II of FIG. 1.
Figure 3:
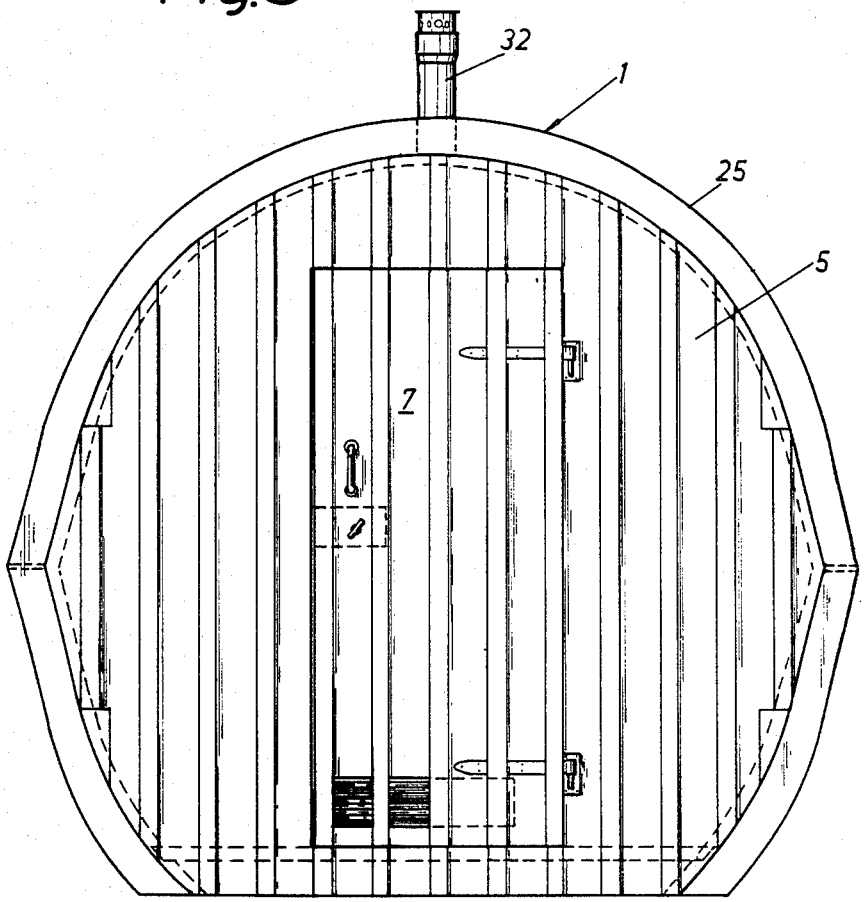
FIG. 3 is a front view of the forwards end wall of the bomb shelter.

A ventilation system is installed in the shelter. FIGS. 2 and 3 show an air evacuation outlet 32. The outlet is preferably equipped with a system of non-return valves to prevent air from entering into the shelter. Air inlets are not shown in the drawings but consist of two separate pipe mouths which are preferably covered by mounds of stones. The pipe mouths are connected to manifolds which are in communication with the interior of the bomb shelter via filters designed to clean the incoming air. A simple manually operated fan serves to achieve air circulation. When the shelter/celler storage 1 is used for civilian purposes ventilation occurs also through the doors made in the end walls 5, 6. However, in emergency situations the ventilation facilities through these doors are sealed off.

A bomb shelter manufactured in accordance with the teachings of the subject invention offers adequate protection while at the same time it is inexpensive to manufacture and to install, making it a realistic alternative to large-size conventional bomb shelters. The bomb shelters in accordance with the invention consist of small units and are easily installed in most places. Because they can also be used in peacetime, doubling as underground storage cellers, they can be fully utilized at all times.

The embodiment described in the aforegoing and illustrated in the drawings is but one example of the invention but a variety of modifications are possible within the scope of the appended claims. For instance, the front end wall 5 may be made from fiberglass-reinforced plastics instead of from wood and may also be given an outwardly bulging configuration corresponding to the dome-shape of the rear end wall in order better to resist pressure waves.

What we claim is:

1. A bomb shelter to accommodate a small group of people, comprising an essentially cylindrical body of fiberglass-reinforced plastics having a generally smooth outer surface, said cylindrical body consisting of separate upper and lower sections, peripheral reinforcing stiffening members extending circumferentially around the wall of said shelter body and projecting into the interior thereof, lengthwise stiffening members formed in said bomb shelter body, the cross-over points between said peripheral stiffening members and said lengthwise stiffening members arranged to ensure that the smaller ones of said stiffening members extend uninterrupted through indentations formed in the larger ones of said stiffening members, whereby both said smaller and said larger stiffening members will be continuous, sealed joints interconnecting said sections to form said cylindrical body, an external end wall at the forward end of said bomb shelter and supportingly engaged with the outer-forward surface of one of said stiffening members and an inner end wall spaced a predetermined distance from said external end wall and supportingly engaged with the outer forward surface of another of said reinforcing members whereby said stiffening members support said walls against external blasts, and one door in each of said end walls, said doors arranged to be opened outwards.

2. A bomb shelter as claimed in claim 1, comprising said shelter buried at least partly in the ground and covered by insulating materials.

3. A bomb shelter as set forth in claim 2 wherein at least the door in the external end wall is exposed when the shelter is buried in the ground for permitting direct access to said external wall door.

4. A bomb shelter to accommodate a small group of people, comprising an essentially cylindrical body of fiberglass-reinforced plastics having a generally smooth outer surface, said cylindrical body consisting of separate upper and lower sections, peripheral reinforcing stiffening members extending circumferentially around the wall of said shelter body and projecting into the interior thereof, sealed joints interconnecting said sections to form said cylindrical body, an external end wall at the forward end of said bomb shelter and supportingly engaged with the outer forward surface of one of said stiffening members and an inner end wall spaced a predetermined distance from said external end wall and supportingly engaged with the outer forward surface of another of said reinforcing members whereby said stiffening members support said walls against external blasts, one door in each one of said end walls, said doors arranged to be opened outwards, and a continuous laminate structure forming the floor of said bomb shelter, an inner floor applied on top of an outer shelter floor, and shock-absorbing means arranged between said outer shelter floor and said inner floor.

* * * * *